US006934986B2

(12) United States Patent
Krywiczanin et al.

(10) Patent No.: US 6,934,986 B2
(45) Date of Patent: Aug. 30, 2005

(54) POWER AND ELECTRICAL SIGNAL INTERFACE FOR A THERAPEUTIC BED

(75) Inventors: Wladyslaw H. Krywiczanin, Ringwood (GB); Christopher T. Niederkrom, San Antonio, TX (US); Mark Beard, Ferndown (GB); David Whyte, Wareham (GB)

(73) Assignee: KCI Licensing, Inc., San Antonio, TX (US)

( * ) Notice: Subject to any disclaimer, the term of this patent is extended or adjusted under 35 U.S.C. 154(b) by 110 days.

(21) Appl. No.: 10/619,286

(22) Filed: Jul. 14, 2003

(65) Prior Publication Data

US 2004/0010849 A1 Jan. 22, 2004

Related U.S. Application Data

(60) Continuation of application No. PCT/IE02/00085, filed on Jun. 26, 2002, which is a division of application No. 09/812,552, filed on Mar. 29, 2001, now Pat. No. 6,671,905.

(30) Foreign Application Priority Data

Jun. 26, 2001 (IE) ..... S2001/0589

(51) Int. Cl.[7] ..... A47C 21/08; A61G 7/008; A61G 7/057

(52) U.S. Cl. ..... 5/607; 5/609; 5/600

(58) Field of Search ..... 5/607, 609, 600, 5/658, 503.1, 507.1, 424

(56) References Cited

U.S. PATENT DOCUMENTS

| | | | | |
|---|---|---|---|---|
| 3,614,951 A | | 10/1971 | Caro | |
| 3,638,642 A | | 2/1972 | Heflin, Sr. | |
| 4,868,937 A | | 9/1989 | Connolly | |
| 4,907,845 A | | 3/1990 | Wood | |
| 4,947,152 A | | 8/1990 | Hodges | |
| 5,275,132 A | * | 1/1994 | Oloff | 434/34 |
| 5,592,153 A | | 1/1997 | Welling et al. | |
| 5,600,305 A | | 2/1997 | Stafford et al. | |
| 6,014,626 A | | 1/2000 | Cohen | |
| 6,352,504 B1 | | 3/2002 | Ise et al. | |
| 6,441,742 B1 | | 8/2002 | Lovely et al. | |

FOREIGN PATENT DOCUMENTS

| | | |
|---|---|---|
| WO | WO 97/22323 | 6/1997 |
| WO | WO 99/62454 | 6/1999 |

OTHER PUBLICATIONS

"Energy Chain Systems," IGUS Catalog, pp. 1.36–1.39; May 2000.

* cited by examiner

*Primary Examiner*—Alexander Grosz

(57) ABSTRACT

A direct electrical signal and power interface is provided to the patient support platform of a therapeutic bed that allows for a complete rotation of the patient support platform in either direction. In one embodiment, an electrical signal and/or power cable is housed within a chain-like cable carrier that is disposed within an annular channel attached to the patient support platform. In another embodiment, a flexible ribbon cable is disposed within the annular channel. The cable carrier or ribbon cable is long enough to allow a full 360 degrees of rotation of the patient support platform in either direction from 0 degrees supine flat while maintaining a direct electrical signal or power connection. To ensure that the electrical signal and power connection is not articulated beyond its physical limit as a result of manually rotating the bed in the emergency backup mode, a mechanical stop is provided to limit rotation of the patient support platform to about 730 degrees. Sensors are provided to detect activation of the mechanical stop.

20 Claims, 17 Drawing Sheets

POWER AND ELECTRICAL SIGNAL INTERFACE FOR A THERAPEUTIC BED

RELATED APPLICATION INFORMATION

This application is a continuation of PCT/IE02/00085 file Jun. 26, 2002, which is a division of Ser. No. 09/812,552 filed Mar. 29, 2001 now U.S. Pat. No. 6,671,905.

BACKGROUND OF THE INVENTION

1. Field of the Invention

This invention relates generally to therapeutic beds, and more particularly to beds with a patient support platform operable to rotate about a longitudinal axis of the platform.

2. Description of the Related Art

One of the problems in the art of prone positioning therapeutic beds is to provide electrical signal and power connections to the bed for both the power and controller equipment that moves the bed and for the patient monitoring systems on the bed. To allow unrestricted rotation of the bed of WO 99/62454, for example, electrical power has been provided by wire brushes at the interface between the rotating part of the bed and the nonrotating part of the bed. However, due to vibration and other abrupt movements, such wire brushes cause problems of electrical intermittence, which can be detrimental to the therapy of the patient. A direct electrical signal or data carrier would be preferable to eliminate such intermittence, provided that the wired connection is capable of articulation during movement of the rotating part of the bed into the prone position, and provided that a mechanism is provided to prevent excessive rotation in any one direction.

SUMMARY OF THE INVENTION

In U.S. patent application Ser. No. 09/812,552 filed Mar. 29, 2001, and Ser. No. 09/884,749 filed Jun. 19, 2001, the first of which is herein incorporated by reference, a prone positioning bed is disclosed that encompasses several distinct innovations. This divisional application is directed to a mechanism to provide a direct, wired connection to the patient support platform.

A therapeutic bed in accordance with the present invention is provided comprising a base frame, a patient support platform rotatably mounted on the base frame for rotational movement about a longitudinal rotational axis of the patient support platform, and a drive system for rotating the patient support platform on the base frame. A direct, wired connection is provided to the patient support platform that allows for a complete rotation of the patient support platform in either direction. The necessary electrical wires are housed within a chain-like cable carrier that is disposed within an annular channel attached to the patient support platform. An annular cover is installed adjacent the annular channel to retain the cable carrier within the annular channel, but the annular cover is not attached to the annular channel. Rather, the annular cover is attached to the nonrotating part of the bed. One end of the cable carrier is attached to the annular channel, and the other end is attached to the annular cover. The length of the cable carrier is sufficient to allow a full 360 degree rotation of the patient support platform in either direction from 0 degrees supine flat while maintaining a direct electrical connection.

More preferably, the direct, wired electrical connection to the patient support platform may be provided with a flat ribbon cable or flexible printed circuit board (PCB) cable in lieu of a chain-like cable carrier. The cable resides within an annular channel attached to the patient support platform, and an annular cover is fastened to a flange of the annular channel such that a gap exists between the annular channel and the annular cover around the outer periphery. One end of the cable is attached to the annular channel, which provides power and electrical signals to the rotating part of the bed, and the other end of the cable passes through the gap between the annular channel and the annular cover and is connected to the electrical apparatus on the nonrotating part of the bed. Like the cable carrier mentioned above, the cable has a length sufficient to allow a full rotation of the patient support platform in either direction while maintaining a direct electrical connection between the nonrotating and rotating parts of the bed. To ensure that the wired electrical connection is not articulated beyond its physical limit as a result of manually rotating the bed in the emergency backup mode, a mechanical stop is provided to limit rotation of the patient support platform to about 365 degrees. Sensors are provided to detect activation of the mechanical stop.

It is an object of this invention to provide a prone positioning therapeutic bed having a direct, wired electrical connection between the rotating part of the bed and the nonrotating part of the bed.

It is another object of this invention to mechanically limit rotation of the bed in either direction to one full 360 degree turn plus about 5 degrees, and to electrically detect when one full turn has been reached.

Further objects and advantages of the present invention will be readily apparent to those skilled in the art from the following detailed description taken in conjunction with the annexed sheets of drawings, which illustrate a preferred embodiment of the invention.

DETAILED DESCRIPTION

Figure 1:
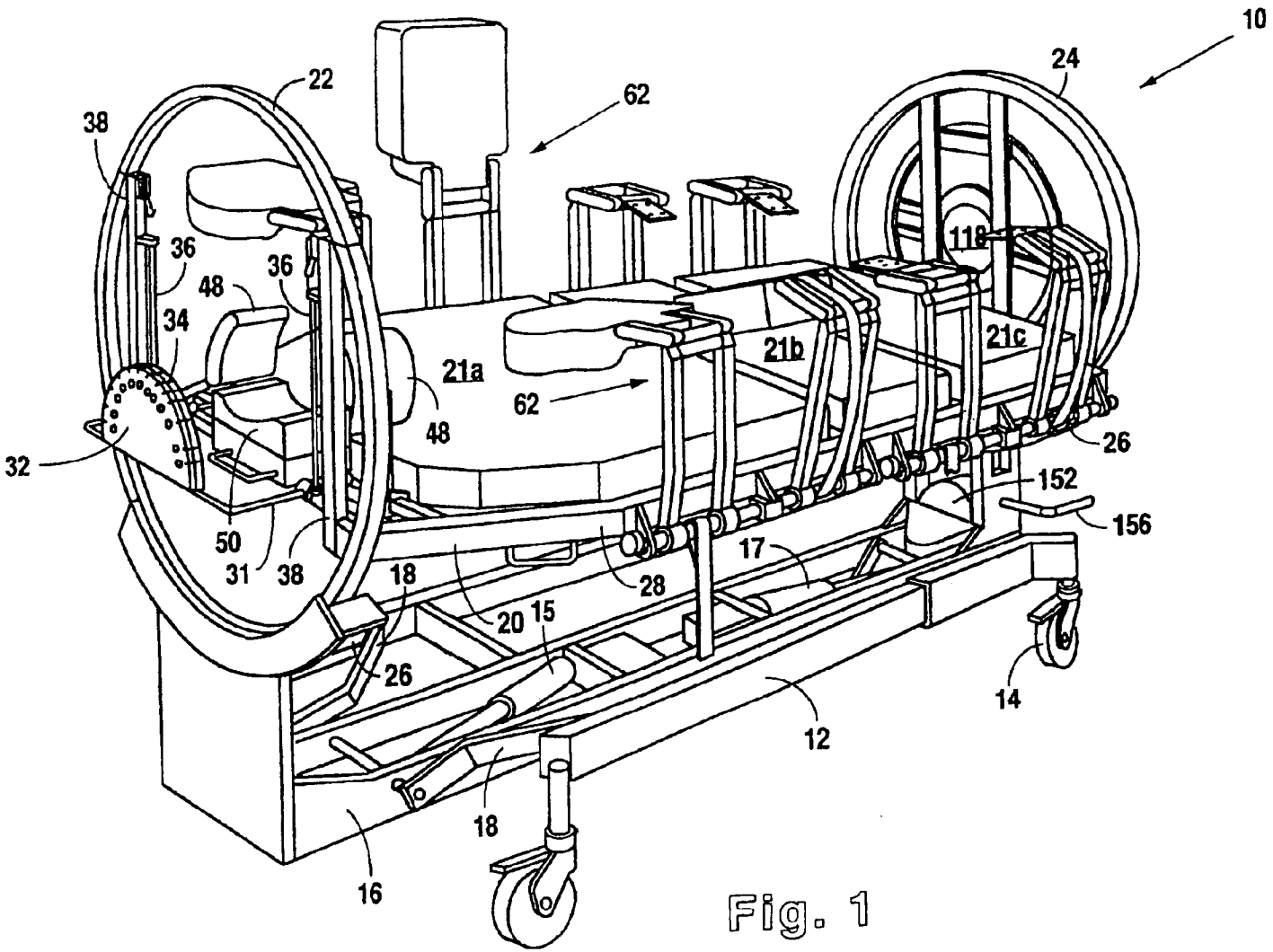
FIG. 1 is a perspective view of a therapeutic bed in accordance with the present invention.
Figure 2:
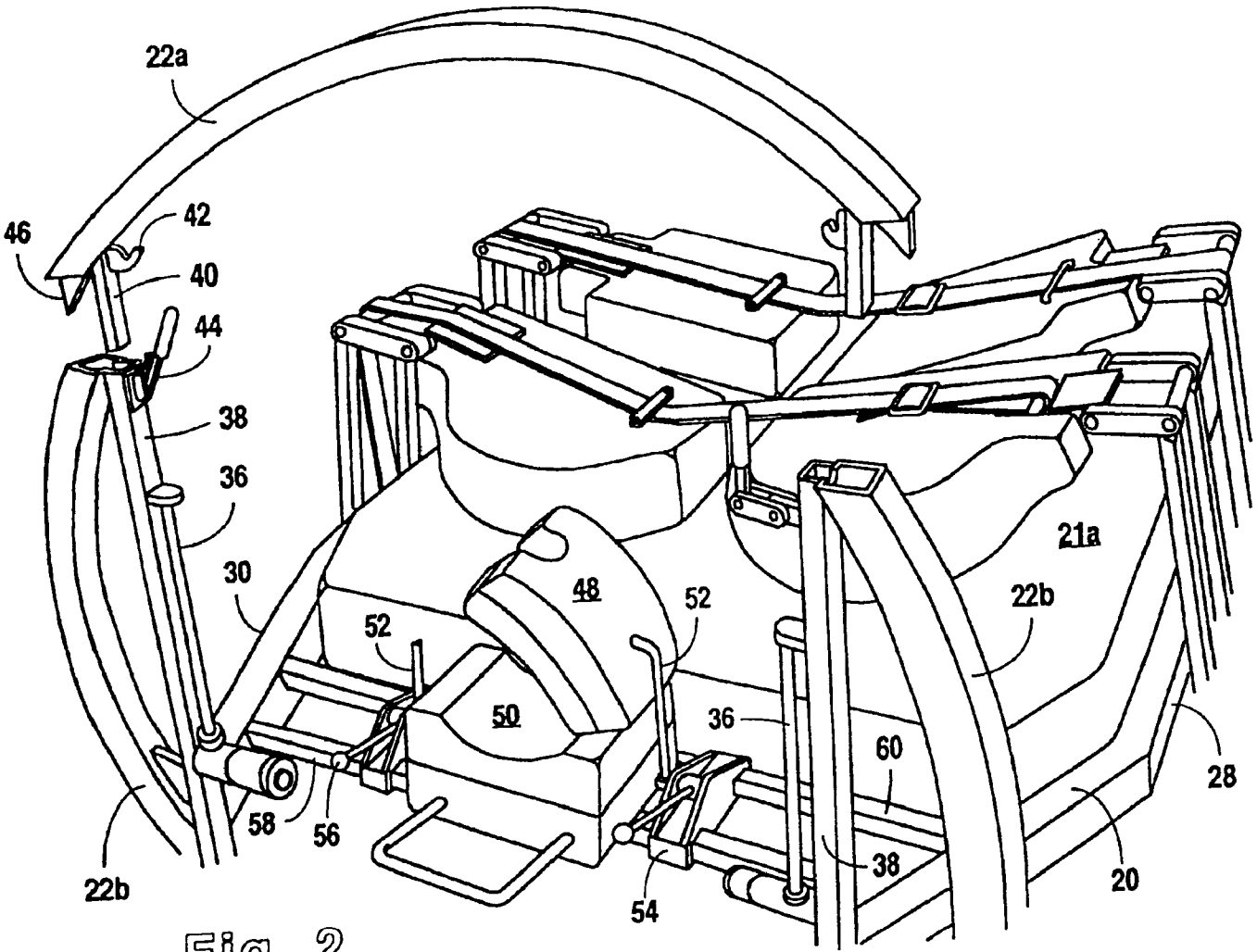
FIG. 2 is a perspective view of the head portion of the therapeutic bed of FIG. 1 looking toward the foot of the bed.

Referring to FIGS. 1 and 2, a therapeutic bed 10 in accordance with the present invention preferably comprises a ground engaging chassis 12 mounted on wheels 14. A base frame 16 is mounted on chassis 12 with pivot linkages 18. Rams 15, 17 housed within base frame 16 cooperate with pivot linkages 18 to form a lift system to raise and lower base frame 16 on chassis 12. A patient support platform 20 having upright end rings 22, 24 is rotatably mounted on base frame 16 with rollers 26 such that patient support platform 20 may rotate about a longitudinal axis between a supine position and a prone position. Side support bars 28, 30 extend between end rings 22, 24. At the head of bed 10, a guide body 32 having a plurality of slots 34 for routing patient care lines (not shown) is slidably mounted on rails 36 with support rod 31. Similarly, at the foot of bed 10, a central opening 118 is provided for receiving a removable patient care line holder (not shown) having a plurality of circumferential slots for routing patient care lines. Central opening 118 is preferably of sufficient size to allow passing of patient connected devices, such as foley bags (not shown), through the central opening 118 without disconnecting such devices from the patient. For such purposes, central opening 118 is preferably as large as possible, provided that strength and configuration requirements of the bed are maintained. The foregoing basic structure and function of bed 10 is disclosed in greater detail in international application number PCT/IE99/00049 filed Jun. 3, 1999, which is incorporated herein by reference.

Still referring to FIG. 1, bed 10 preferably comprises one or more folding side rails 62 pivotally mounted to patient support platform 20 to assist in securing a patient to support platform 20 before rotation into the prone position. As further described below in connection with FIG. 15, side rails 62 fold underneath platform 20 for easy access to a patient lying atop cushions 21*a*, 21*b*, 21*c* in the supine position. Bed 10 also preferably has a head rest 50 and a pair of head restraints 48, which are described in more detail below in connection with FIG. 3.

As shown in FIG. 2, end ring 22 at the head of bed 10 is split into two sections for improved access to a patient lying on bed 10. Upper section 22*a* is removable from lower section 22*b*. Upper section 22*a* has a pair of shafts 40 that are inserted into vertical stabilizer tubes 38 in the closed position. Likewise, tabs 46 on upper section 22*a* mate with tubular openings on lower section 22*b*. Latches 44 secure upper section 22*a* to lower section 22*b* in the closed position. When latches 44 are unlatched, upper section 22*a* may be raised, pivoted about the vertical axis of one of the shafts 40, and left in an open position supported by one of the shafts 40 in corresponding stabilizer tube 38. Alternatively, upper section 22*a* may be removed entirely. In either case, upper section 22*a* may be moved out of the way for unobstructed access to the patient and manipulation of patient care lines. As an alternative to a split end ring, patient support platform 20 could be cantilevered from the base frame at one end of the bed, but such a configuration would be extremely heavy.

Figures 3, 3A:
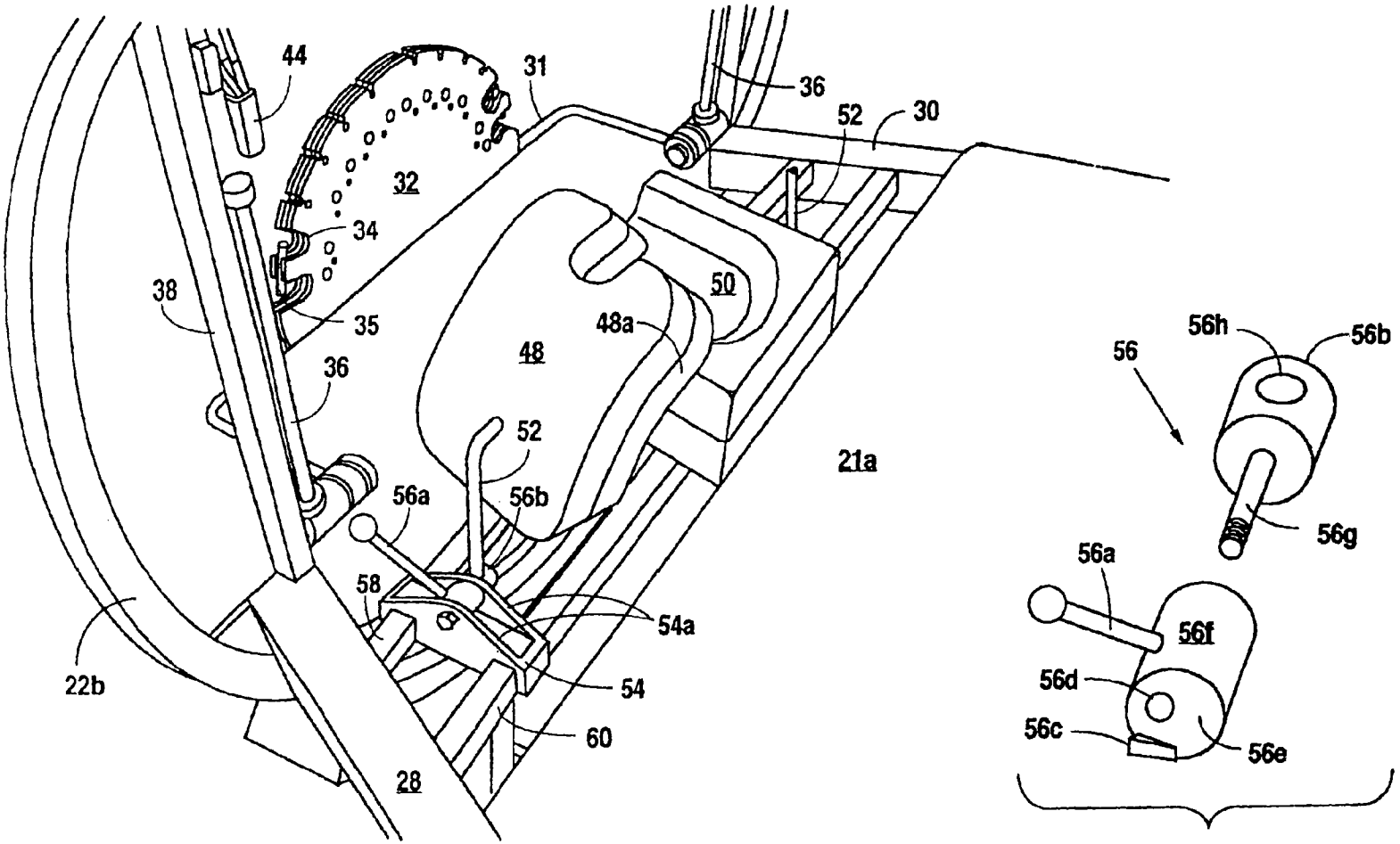
FIG. 3 is a perspective view of the head portion of the therapeutic bed of FIG. 1 looking toward the head of the bed.
FIG. 3A is an exploded perspective view of the clamping mechanism for the head restraints of the therapeutic bed of FIG. 1.

Referring now to FIGS. 3 and 3A, head restraints 48 are slidably mounted to transverse support rails 58, 60 on guides 54 with mounting arms 52. For the sake of clarity, only one head restraint 48 is shown in FIGS. 2 and 3. Each guide 54 has a clamp 56 that is manually operable by a handle 56*a* and serves to secure each guide 54 in a desired lateral position as further described below. Mounting arms 52 are slidably mounted in holes 56*h* of bosses 56*b* to provide vertical positioning of head restraints 48. Handle 56*a* is attached to a drum 56*f* that is rotationally mounted to flanges 54*a* of guide 54 by shaft 56*g* which is disposed within hole 56*d* of drum 56*f* Drum 56*f* has a ramp 56*c* for engaging one of the flanges 54*a* and hole 56*d* is offset from the central axis of drum 56*f* to form a cam 56*e*. Movement of handle 56*a* in the appropriate direction causes ramp 56*c* to engage one of the flanges 54*a* and thereby spread flanges 54*a* apart slightly, which causes one of the flanges 54*a* to frictionally engage mounting arm 52 and thereby fix the vertical position of head restraint 48. Simultaneously, such rotation of handle 56*a* causes cam 56*e* to frictionally engage one of the transverse support rails 58, 60 and thereby fix the lateral position of head restraint 48. Thus, clamps 56 simultaneously provide both lateral and vertical positioning of head restraints 48, which have pads 48*a* for comfortably engaging the front and sides of the head of a patient whose head is resting on head rest 50. Head rest 50 may be mounted to transverse support rails 58, 60 or to pad 21*a*. Head restraints 48 thereby provide increased stability and comfort for a patient when bed 10 is rotated to the prone position.

Figure 2A:
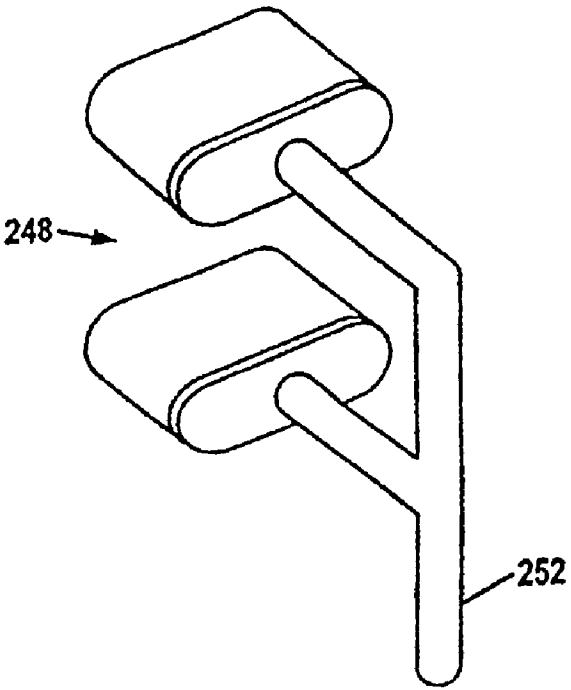
FIG. 2A is a perspective view of an alternative head restraint for the therapeutic bed of FIG. 1.

If a particular patient requires only partial rotation for therapy such that patient support platform 20 need not be rotated beyond about, for example, 30 degrees in either direction, alternative head restraints 248 as shown in FIG. 2A may be mounted in clamps 56 using mounting arms 252 in like manner as head restraints 48. Alternative head restraint 248 is designed to provide lateral support for the patient's head in instances when the patient will not be rotated into the prone position such that vertical restraint of the head is not required.

Figure 4:
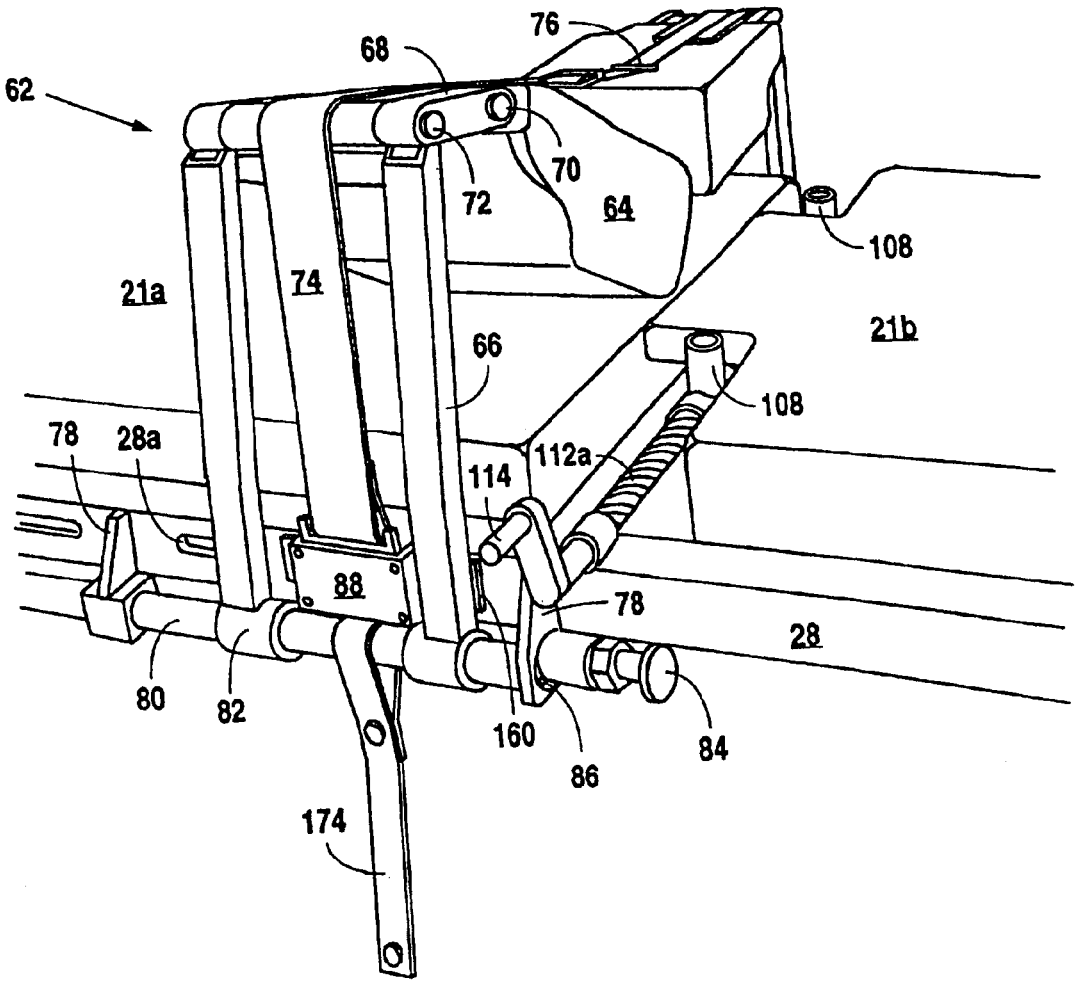
FIG. 4 is a perspective view of a side rail of the therapeutic bed of FIG. 1.
Figure 15:
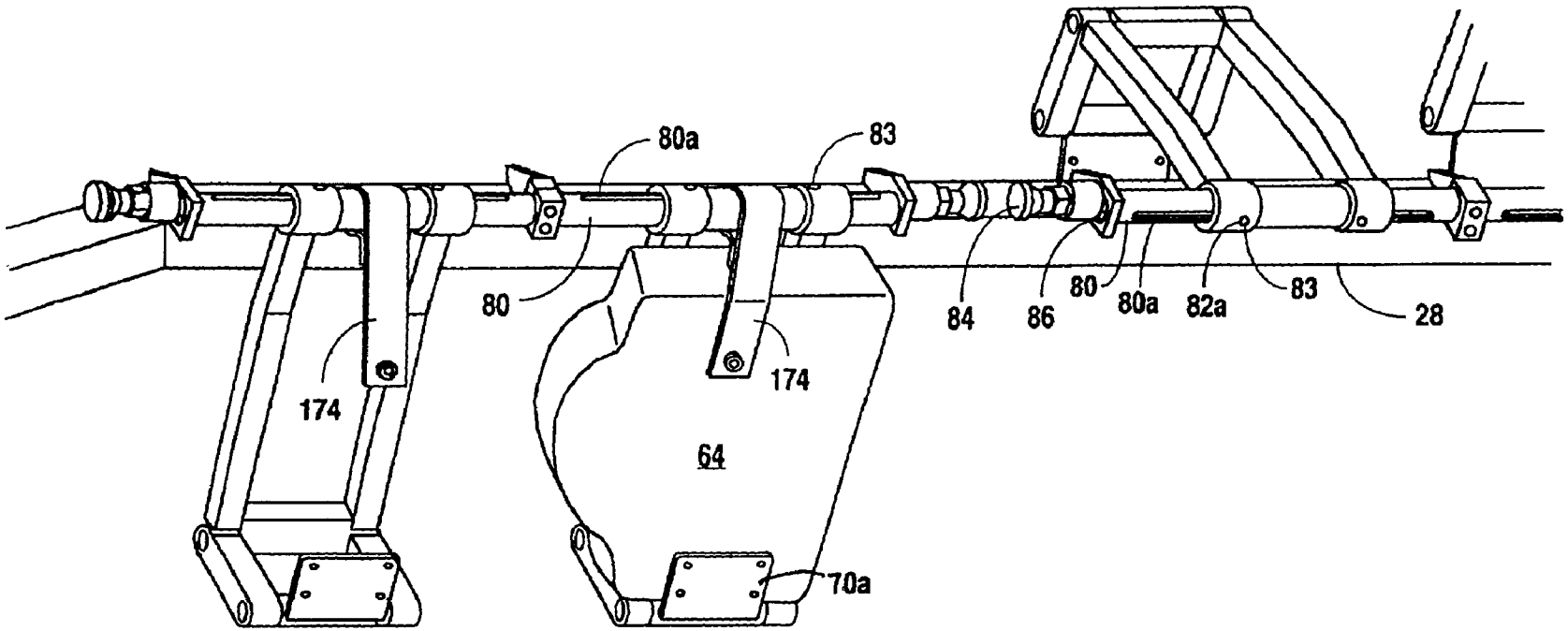
FIG. 15 is a perspective view looking up at a side rail folded under the patient support platform of the therapeutic bed of FIG. 1.

FIGS. 4 and 15 illustrate a preferred structure and operation of folding side rails 62. Preferably, four independently operable side rails 62 are pivotally mounted on each side of bed 10. For each side rail 62, main rail 66 is slidably mounted on shaft 80 with mounting cylinders 82. Shaft 80 has a slot 80*a* for receiving guides such as set screws 83 installed in holes 82*a* of mounting cylinders 82. Preferably, set screws 83 are not tightened against slot 80*a* but simply protrude into slot 80*a* to prevent side rail 62 from rotating with respect to shaft 80. In that regard, set screws 83 could be replaced with unthreaded pins. When set screws 83 are loosened, side rail 62 is free to slide longitudinally along shaft 80 for proper positioning with respect to the patient. When set screws 83 are tightened, side rail 62 is fixed with respect to shaft 80. Shaft 80 is rotatably mounted to side support bar 28, 30 with rail mounts 78. Pivot link 68 is hinged to main rail 66 with hinge 72, and cushion 64 is hinged to pivot link 68 with hinge 70, which has a hinge plate 70*a* for attaching cushion 64. Side rails 62 are thus capable of folding under patient support platform 20 as shown in FIG. 15, which is a view looking up from beneath patient support platform 20. A strap 174 with one end secured around shaft 80 may be provided to retain cushion 64 in the folded under position with mating portions of a snap respectively provided on cushion 64 and strap 174. A pair of straps 74 and an adjustable buckle 76 are provided to fasten each opposing pair of side rails 62 securely over the patient. One end of strap 74 is secured to side support bar 28 with a strap connector 88, which is 15 slidably mounted in slot 28*a* of side support bar 28. When strap 74 is properly secured with the appropriate tension using buckle 76, tabs 160 on strap connector 88 are sandwiched between main rail 66 and side support bar 28, which further helps to prevent longitudinal movement of side rail 62. Side rails 62 thus serve to hold the patient securely in place as bed 10 is rotated into the prone position, and side rails 62 fold neatly out of the way for easy access to the patient in the supine position.

Figure 4A:
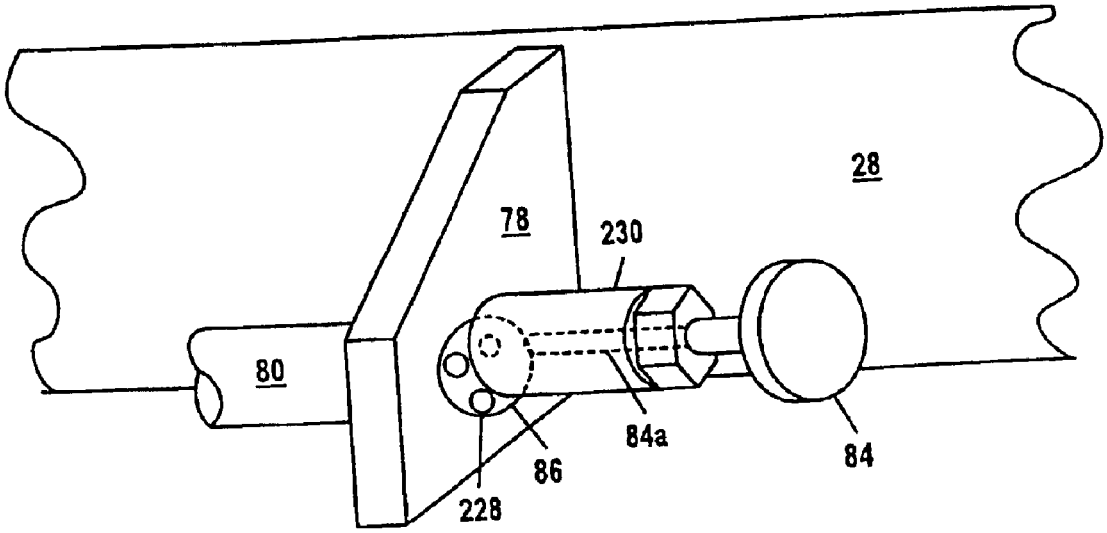
FIG. 4A is a perspective view of the detent for the side rail of FIG. 4.

As best illustrated in FIG. 4A, an indexed disc 86 is preferably provided on one end of shaft 80 for cooperation with a pull knob 84 to form a detent that holds side rail 62 in one or more predetermined rotational positions. To that end, disc 86 preferably has one or more recesses 228 for receiving a pin 84*a* which is manually operated by pull knob 84. Pull knob 84 is fixedly mounted to rail mount 78 with boss 230. Preferably, pin 84*a* is biased into engagement with disc 86. By engaging one of the recesses 228, pin 84*a* prevents rotation of shaft 80 and thereby functions as a detent to hold side rail 62 in a predetermined rotational position. Side rail 62 may be moved to a different predetermined rotational position by pulling knob 84 sufficiently to disengage pin 84*a* from the given recess 228 so that shaft 80 is free to rotate. Preferably, one of the predetermined rotational positions of side rail 62 corresponds to the folded under position.

Figure 5:
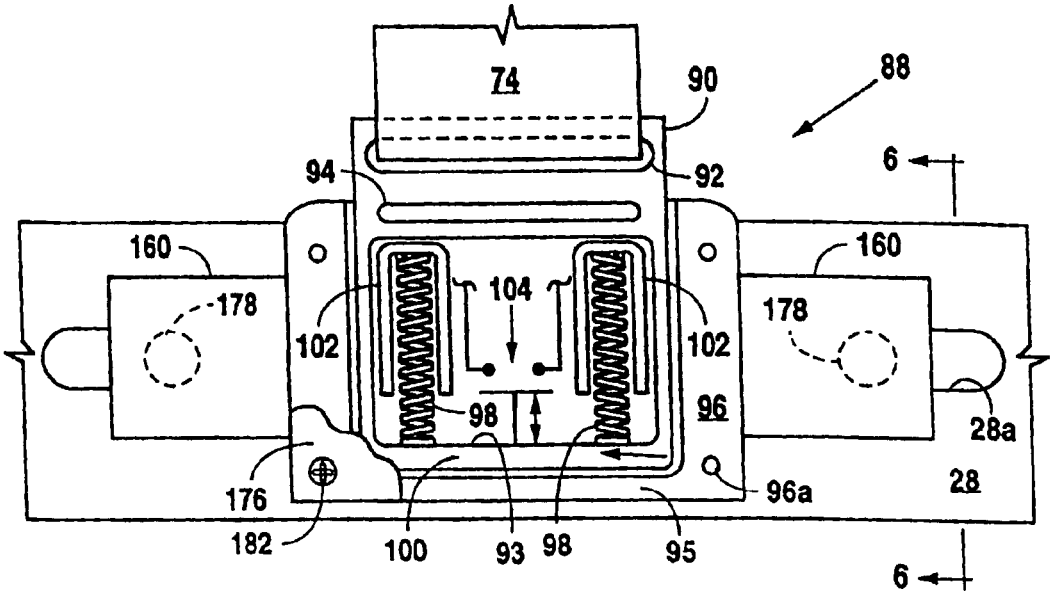
FIG. 5 is a side elevational view of a strap connector for the side rail of FIG. 4.
Figure 6:
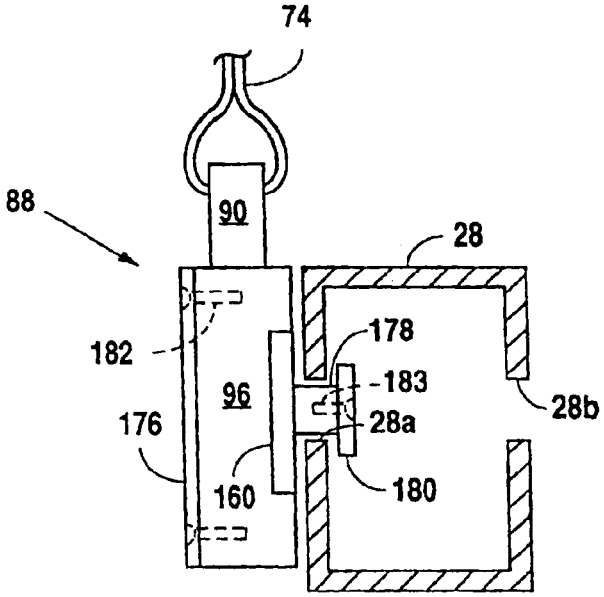
FIG. 6 is a rear elevational view of the strap connector of FIG. 5.

Referring now to FIGS. 5 and 6, each strap connector 88 comprises a tension-sensitive mechanism that provides both visual and electrical indications of whether strap 74 is properly secured over the patient. The following description describes the attachment of a strap connector 88 to side support bar 28. It will be understood that strap connectors 88 may be similarly attached to side support bar 30. Each strap connector 88 comprises a tension plate 90 that partially resides within a housing 96. A cover plate 176 is attached to housing 96 by fasteners 182 inserted into holes 96*a*. Tabs 160 extend from housing 96, and studs 178 protrude from tabs 160 as shown. Discs 180 are mounted to studs 178 with screws 183. Slots 28*b* on the inner side of support bar 28 provide access for installation of screws 183. Studs 178 are adapted to slide in slots 28*a* of side support bar 28, and discs 180 serve to retain strap connector 88 on side support bar 28. Tension plate 90 has a slot 92 to which strap 74 is attached and a central cut-out 93 that forms a land 100. Inverted U-shaped channels 102 protrude from the back of housing 96 into central cut-out 93 of tension plate 90. Land 100 of tension plate 90 cooperates with channels 102 of housing 96 to capture springs 98 which tend to force tension plate 90 downward toward lower edge 95 of housing 96 such that switch 104 is disengaged when strap 74 is slack. Switch 104 is connected to an electrical monitoring and control system (not shown) in a customary manner. When strap 74 is buckled and tightened sufficiently, the tension in strap 74 overcomes the biasing force of springs 98, and tension plate 90 moves upward to engage switch 104, which sends a signal to the electrical monitoring and control system indicating that strap 74 is properly tensioned. Preferably, the electrical monitoring and control system is programmed such that bed 10 cannot rotate until each strap 74 is properly tensioned to ensure that the patient will be safely secured in bed 10 as it rotates to the prone position. Additionally, tension plate 90 preferably has a tension indicator line 94 that becomes visible outside housing 96 when strap 74 is properly tensioned.

Figure 16:
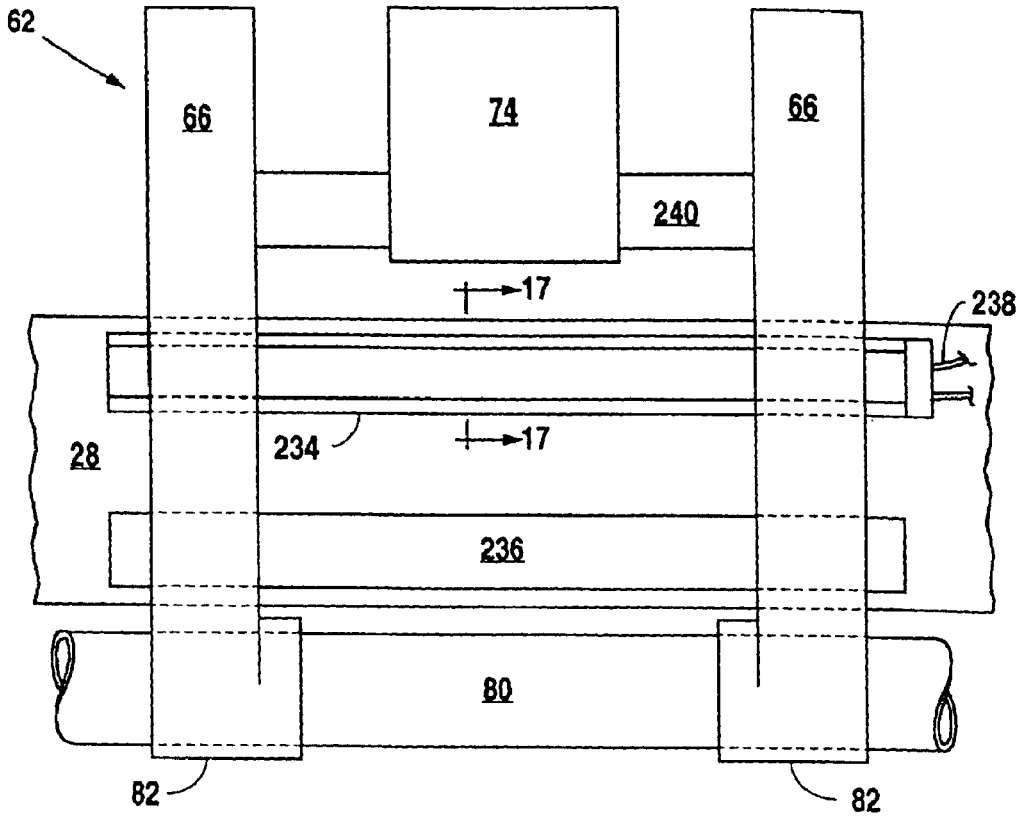
FIG. 16 is a side elevational view of a side rail and cooperating tape switch on a therapeutic bed in accordance with the present invention.

More preferably, as illustrated in FIG. 16, instead of utilizing tension-sensitive strap connectors 88, a pressure-sensitive tape switch 234 may be installed to side support bars 28, 30 adjacent each side rail 62. Tape switch 234 is preferably of the type commonly available from the Tape Switch company. Strap 74 is attached to a crossbar 240 that spans main rails 66. When strap 74 is properly tensioned, main rails 66 depress tape switch 234, which sends a signal through electrical leads 238 to the monitoring and control system indicating that side rail 62 is properly secured over the patient. Preferably, the monitoring and control system s programmed such that the patient support platform 20 is not allowed to rotate into the prone position unless all side rails 62 have been properly secured as indicated by tape switches 234. To help calibrate each tape switch 234, a pad 236 may be attached to side support bars 28, 30 below the tape switch 234 adjacent each side rail 62. Pads 236 are made of a compressible material, such as rubber, having a suitable hardness and thickness so that, as strap 74 is buckled, main rails 66 will first compress pads 236 and then depress tape switch 234 when strap 74 is buckled to the appropriate tension.

Figure 17:
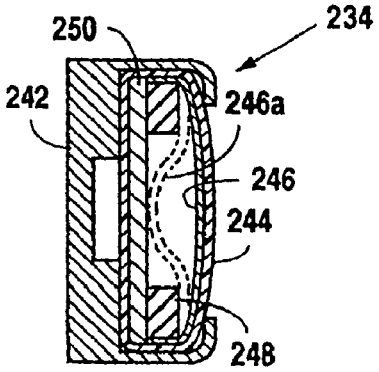
FIG. 17 is a cross-sectional view of the tape switch of FIG. 16.

FIG. 17 illustrates a preferred embodiment of tape switch 234. A mounting bracket 242, which is preferably made of extruded aluminum, houses two conductive strips 250 and 246 that are separated at their upper and lower edges by insulator strips 248. Conductive strip 250 is a planar conductor oriented in a vertical plane as shown. Conductive strip 246 is installed under a preload such that it is bowed away from conductive strip 250 in its undisturbed position. Conductive strips 250, 246 and insulator strips 248 are enclosed within a plastic shroud 244. When main rails 66 engage tape switch 234 with sufficient pressure, conductive strip 246 is displaced to the position shown at 246*a*, which completes the circuit with conductive strip 250 and sends a signal through leads 238 indicating that the strap 74 is properly secured.

Figure 7:
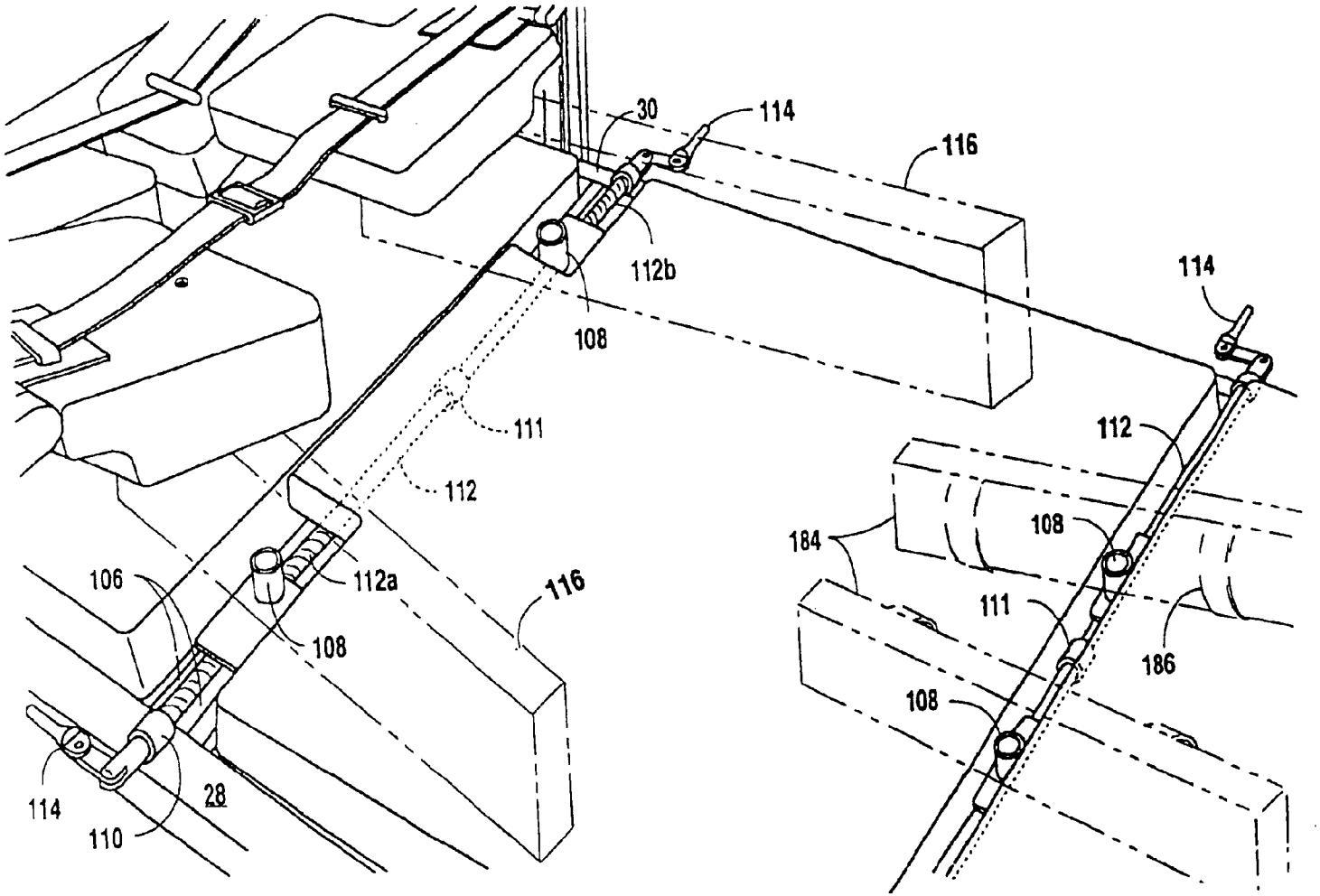
FIG. 7 is a perspective view of the therapeutic bed of FIG. 1 showing symmetric lateral support pads and leg adductors/abductors.
Figure 9:
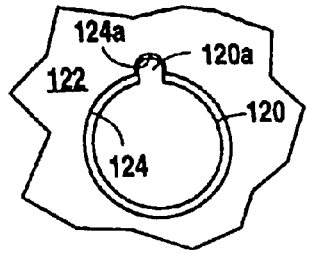
FIG. 9 is a front elevational view of a portion of FIG. 8.

As shown in FIG. 7, bed 10 preferably comprises a pair of lateral support pads 116 for holding a patient in place laterally. Lateral support pads 116 are connected to mounts 108, which are slidably mounted on transverse support rails 106 that span the gap between side support bars 28, 30. Mounts 108 are also threadably engaged with a threaded rod 112, the ends of which are mounted in side support bars 28, 30 with bearings 110. Mounts 108 are symmetrically spaced from the longitudinal centerline of bed 10. Preferably, another bearing 111 supports the 15 middle portion of rod 112, and a manually operable handle 114 is provided on at least one end of rod 112. With respect to element 114, the term "handle" as used herein is intended to mean any manually graspable item that may be used to impart rotation to rod 112. Alternatively, rod 112 may be motor driven. One side 112*a* of rod 112 has right-hand threads, and the other side 112*b* has left-hand threads. By rotating handle 114 in the appropriate direction, lateral support pads 116 are symmetrically moved toward or away from the patient, as desired. Due to the symmetrical spacing of mounts 108 and the mirror image threading 112*a*, 112*b* of rod 112, lateral support pads 116 provide for automatic centering of the patient on bed 10, which enhances rotational stability. Similarly, leg adductors/abductors 184 having straps 186 for securing a patient's legs may be mounted to mounts 108 in like manner as lateral support pads 116. The term "patient support accessory" is used herein to mean any such auxiliary equipment, including but not limited to lateral support pads and leg adductors/abductors, that is attachable to mounts 108 for the purpose of providing symmetric lateral support to a patient on bed 10.

Figure 8:
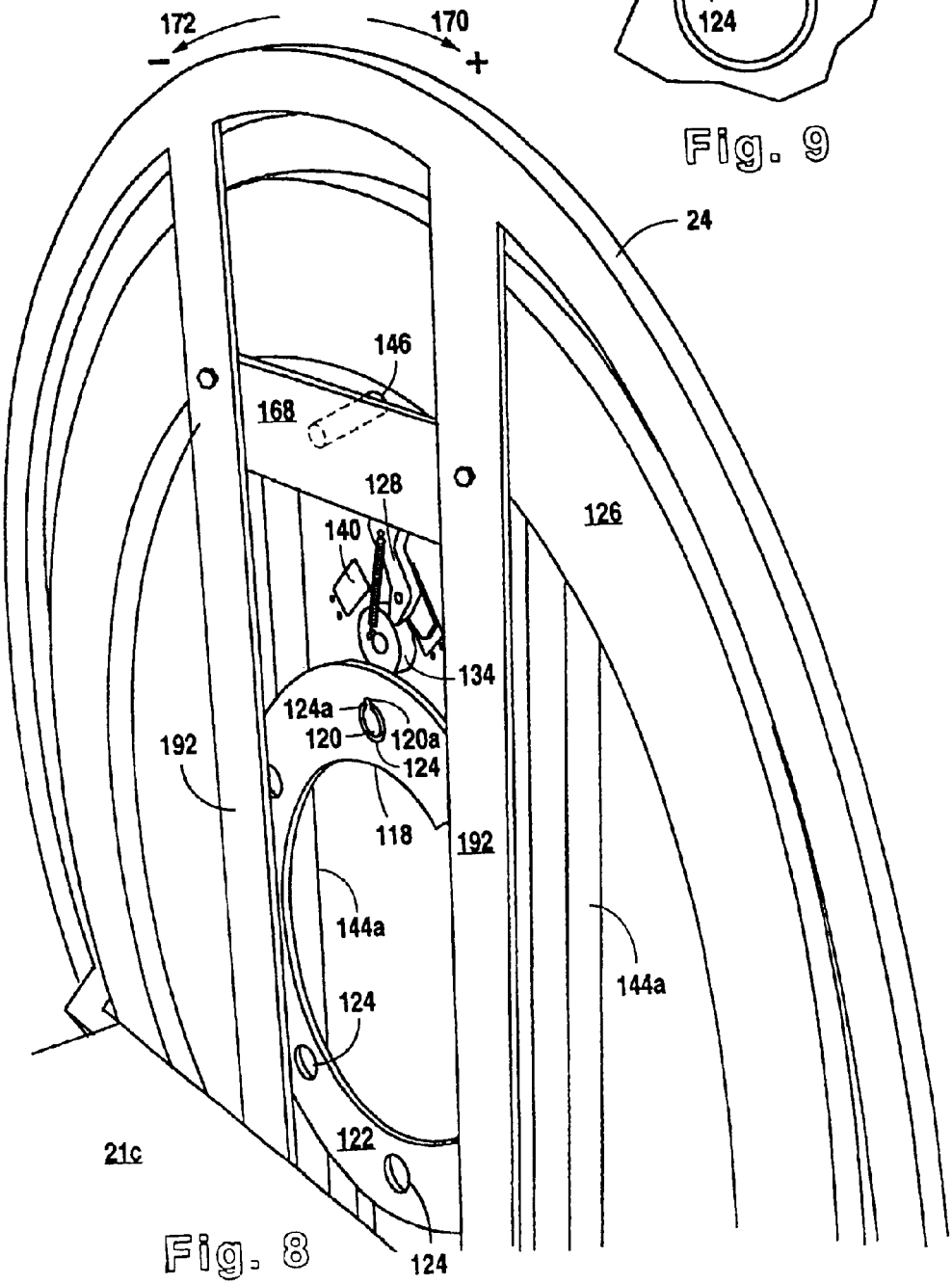
FIG. 8 is a perspective view of the foot portion of the therapeutic bed of FIG. 1 looking toward the foot of the bed.
Figure 10:
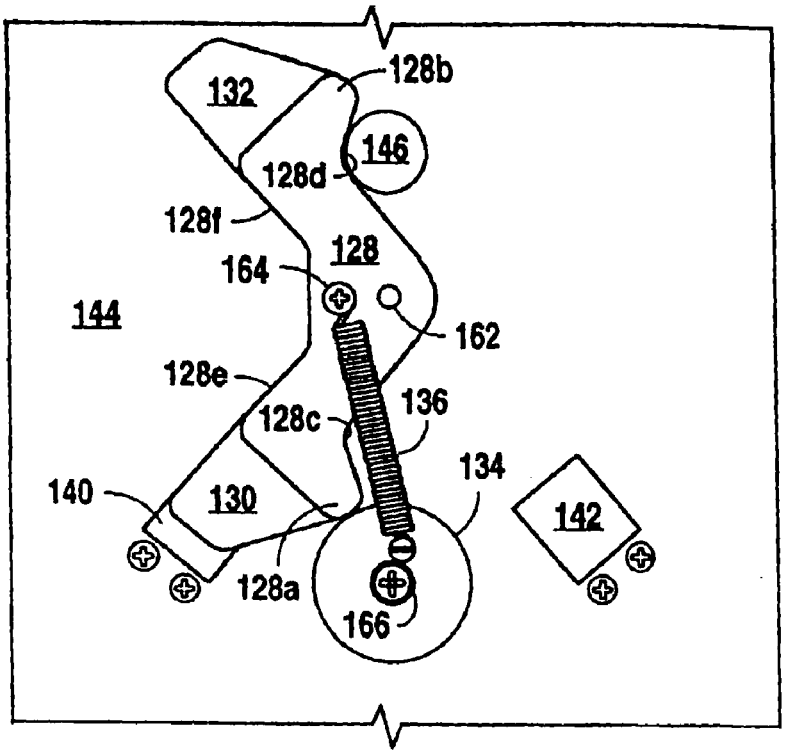
FIG. 10 is a front elevational view of the rotation limiter of the therapeutic bed of FIG. 1 shown in a position of maximum negative rotation.
Figure 11:
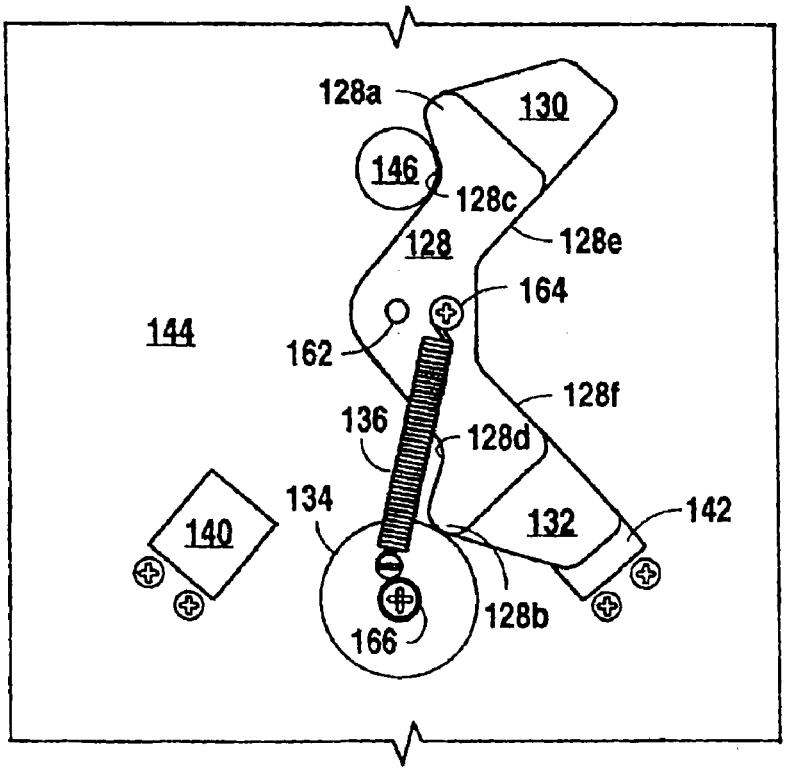
FIG. 11 is a front elevational view of the rotation limiter of the therapeutic bed of FIG. 1 shown in a position of maximum positive rotation.
Figure 12:
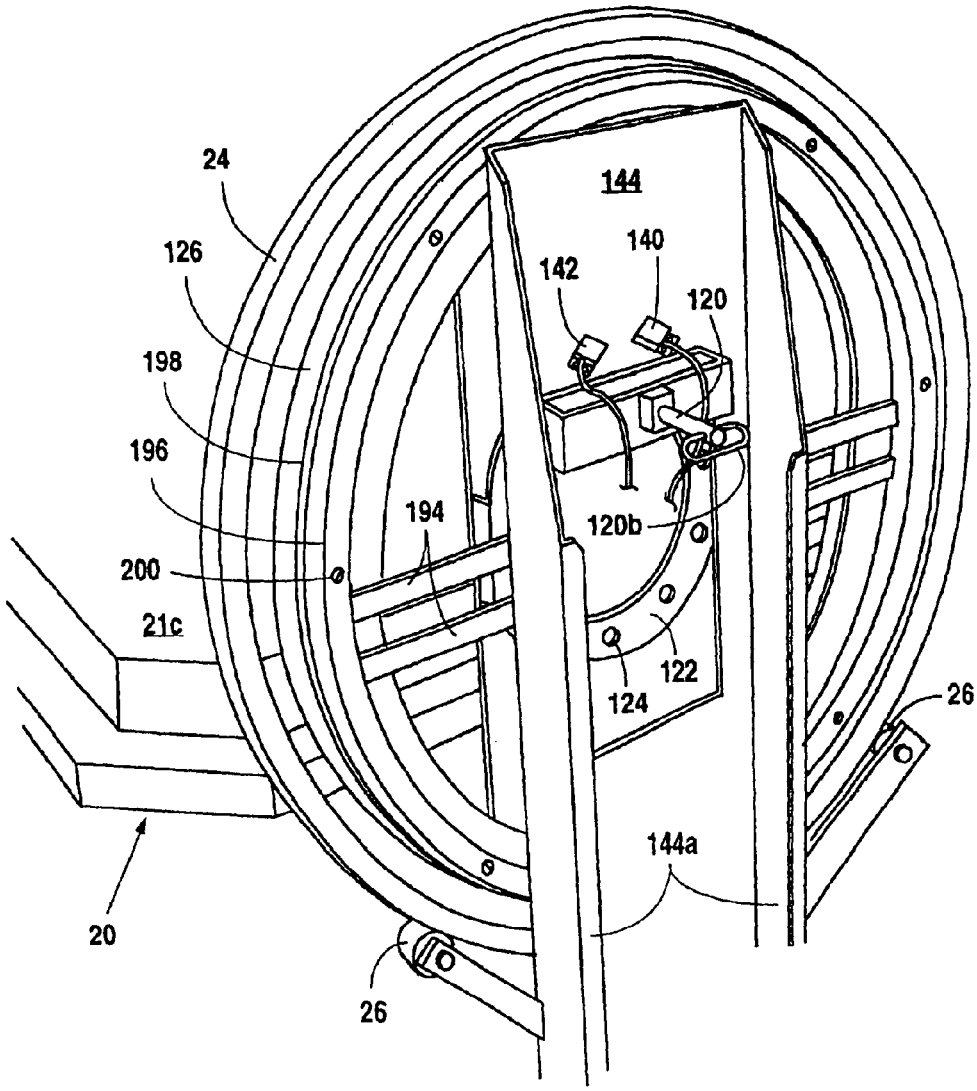
FIG. 12 is a perspective view of the foot portion of the therapeutic bed of FIG. 1 looking toward the head of the bed.
Figure 13:
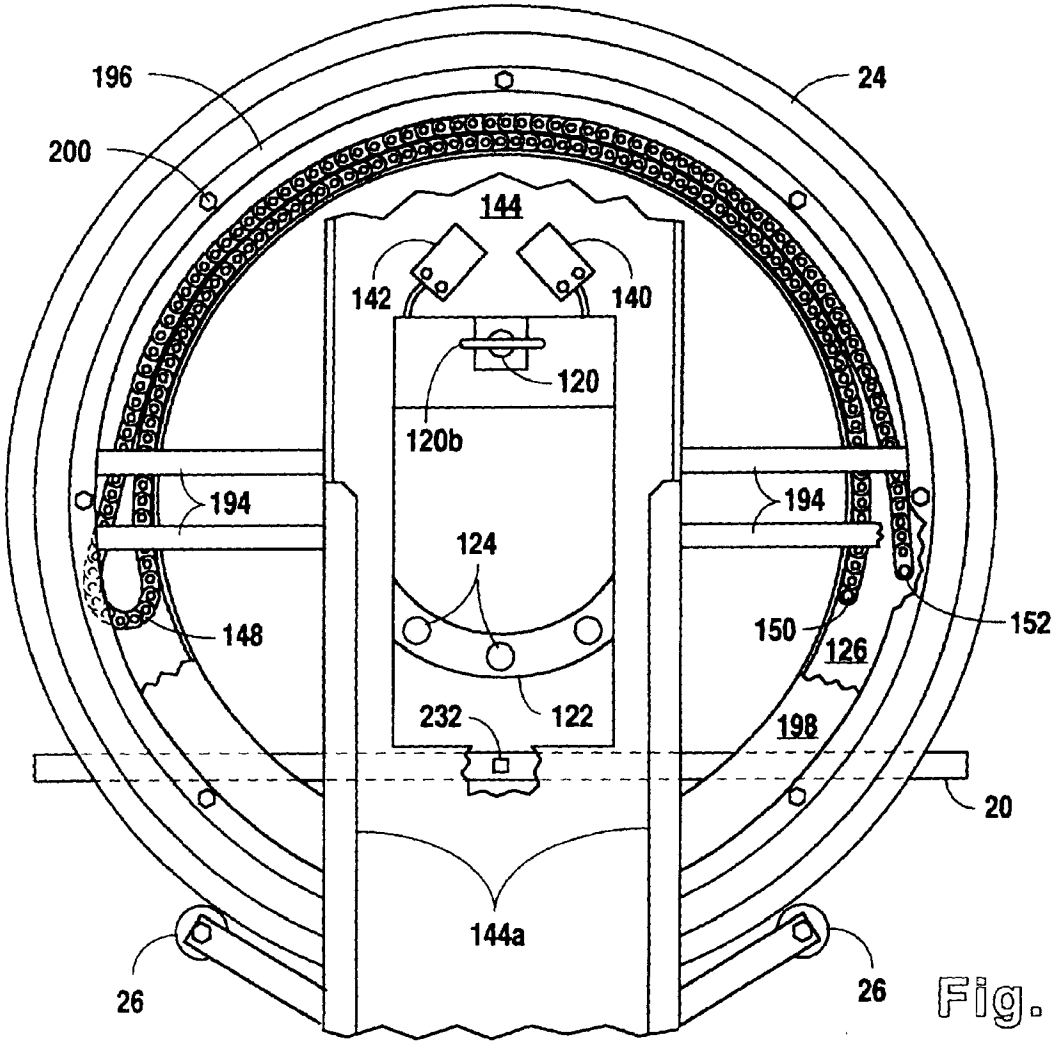
FIG. 13 is a rear elevational view of the therapeutic bed of FIG. 1.

FIGS. 8 through 13 and 22 illustrate an apparatus at the foot of bed 10 for supplying a direct electrical connection between non-rotating base frame 16 and a patient monitoring device 300 connected to a rotating patient support platform 20. As best shown in FIGS. 8 and 13, end ring 24, which is fastened to rotating patient support platform 20, is also connected to an annular channel 126 that serves as a housing for a cable carrier 148. Cable carrier 148 carries an electrical cable 253 comprising power, ground, and signal wires as is customary in the art. Channel 126, which preferably has a C-shaped cross-section, may be attached to end ring 24 by way of support bars 192. Because channel 126 is attached to end ring 24, channel 126 rotates with patient support platform 20. As shown in FIGS. 12 and 13, an annular cover 198 is connected to upright foot frame 144, which extends upward from base frame 16. Cover 198 is preferably mounted on a ring 196 with fasteners 200, and ring 196 is preferably mounted to support bars 194 that extend from stiffeners 144*a* of foot frame 144. Cover 198, which is preferably made of metal to shield cable carrier 148 from radio frequency signals external of bed 10, is positioned longitudinally adjacent channel 126 to retain cable carrier 148 within channel 126, but cover 198 is not connected to channel 126. Thus, channel 126 is free to rotate with end ring 24, but cover 198 is stationary. One end 150 of cable carrier 148 is attached to channel 126, and the other end 152 of cable carrier 148 is attached to cover 198. The length of cable carrier 148 is preferably sufficient to allow patient support platform 20 to rotate a little more than 360 degrees in either direction. This arrangement provides a direct, wire-based electrical connection to the rotating part of bed 10 while still allowing a complete rotation of patient support platform 20 in either direction.

Figure 18:
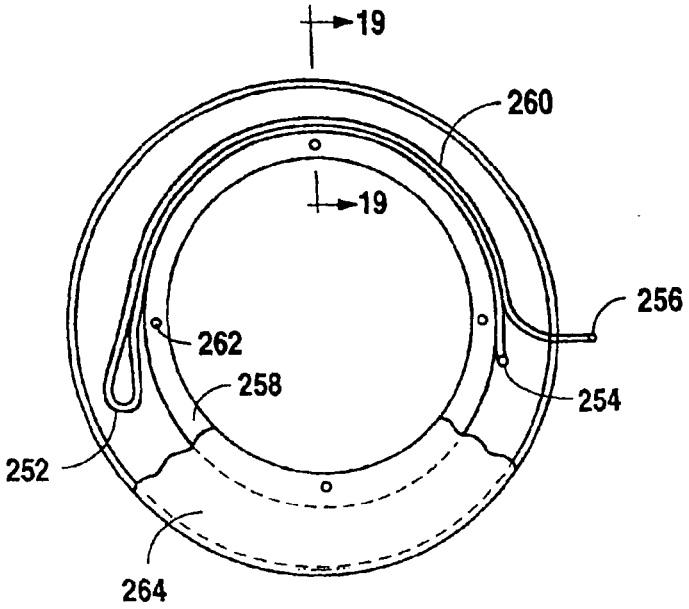
FIG. 18 is a rear elevational view of a flexible cable disposed within an annular channel of a therapeutic bed in accordance with the present invention.
Figure 19:
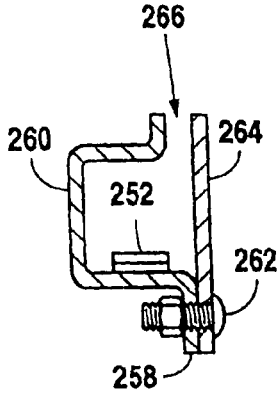
FIG. 19 is a cross-sectional view of the flexible cable and annular channel of FIG. 18.
Figure 20:
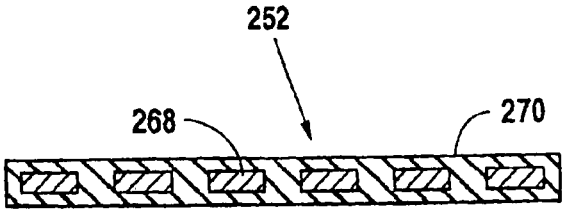
FIG. 20 is an enlarged cross-sectional view of the flexible cable of FIG. 18.

More preferably, as shown in FIG. 18, instead of cable carrier 148, a flexible cable 252 may be used to supply a direct electrical connection between non-rotating base frame 16 and rotating patient support platform 20. FIG. 18 is a view of a preferred embodiment in the same direction as FIG. 13, but FIG. 18 shows only flexible cable 252 and its channel 260 and cover 264 for the sake of clarity. Like channel 126 described above, channel 260 is basically C-shaped in cross-section as shown in FIG. 19. However, channel 260 has an inner flange 258 to which cover 264 is attached, preferably with fasteners 262. Flexible cable 252 resides generally within channel 260. A gap 266 exists between channel 260 and cover 264 through which one end of flexible cable 252 may pass for attachment to non-rotating base frame 16 (not shown) at connection 256. The other end 254 of flexible cable 252 is attached to channel 260, which is attached to rotating patient support platform 20. Like cover 198 above, cover 264 is preferably made of metal to shield flexible cable 252 from radio frequency signals external of bed 10. As shown in FIG. 20, flexible cable 252 comprises a plurality of flexible conductive strips 268 surrounded by a flexible insulator 270. Conductive strips 268 carry signals or ground connections, as desired, and multiple flexible cables 252 may be used if necessary, depending on the number of signals required. Like cable carrier 148 above, flexible cable 252 is preferably long enough to allow patient support platform 20 to rotate a little more than 360 degrees in either direction.

To prevent excessive rotation of patient support platform 20 and the attendant damage that excessive rotation would cause to cable carrier 148 or flexible cable 252 and its enclosed electrical wires, a rotation limiter 128 is provided on the inner surface of upright foot frame 144 as shown in FIGS. 8, 10, and 11. Rotation limiter 128 is pivotally mounted on frame 144 at point 162 and comprises contact nubs 128*a* and 128*b* for engaging a boss 134 that protrudes from frame 144. Thus, rotation limiter 128 may pivot about point 162 between the two extreme positions illustrated in FIGS. 10 and 11. Rotation limiter 128 preferably has a pair of tabs 130, 132 that cooperate with sensors 140 and 142, respectively, which are mounted in frame 144. Sensors 140, 142 are preferably micro switches but may be any type of sensor that is suitable for detecting the presence of tabs 130, 132. By respectively detecting the presence of tabs 130 and 132, sensors 140 and 142 provide an indication of the direction in which patient support platform 20 has been rotated. A spring 136 is attached to rotation limiter 128 at over-center point 164 and to boss 134 at point 166. Spring 136 keeps rotation limiter 128 in either of the two extreme positions until rotation limiter 128 is forced in the opposite direction by a stop pin 146, as discussed below.

Still referring to FIGS. 8, 10, and 11, rotation limiter 128 has fillets 128*c*, 128*d* and flats 128*e*, 128*f* for engaging stop pin 146, which is rigidly attached to crossbar 168. When patient support platform 20 is in its initial supine position (i.e., the position corresponding to zero degrees of rotation and referred to herein as the "neutral supine position"), stop pin 146 is located at the top of its circuit between flats 128*e* and 128*f* As used herein to describe the rotation of end ring 24 and, necessarily, patient support platform 20, "positive" rotation means rotation in the direction of arrow 170 as shown in FIG. 8, and "negative" rotation means rotation in the direction of arrow 172. As end ring 24 is rotated in the positive direction, stop pin 146 engages flat 128*f* and forces rotation limiter 128 into the extreme position shown in FIG. 11 under the action of spring 136. End ring 24 may be rotated slightly more than 360 degrees in the positive direction until stop pin 146 engages fillet 128*c*, at which point rotation limiter 128 prevents further positive rotation. End ring 24 may then be rotated in the negative direction to return to the neutral supine position. As end ring 24 approaches the neutral supine position, stop pin 146 will engage flat 128*e*. Further rotation in the negative direction beyond the neutral supine position will force rotation limiter 128 into the extreme position shown in FIG. 10 under the action of spring 136. End ring 24 may be rotated slightly more than 360 degrees in the negative direction until stop pin 146 engages fillet 128*d*, at which point rotation limiter 128 prevents further negative rotation. In this manner, stop pin 146 and rotation limiter 128 cooperate to limit the rotation of platform 20 so that the electrical wires in cable carrier 148 will not be ripped out of their mountings and the direct electrical connection will be preserved.

Referring to FIGS. 8, 9, 12, and 13, the foot of bed 10 preferably has a positioning ring 122 with a central opening 118 through which patient care lines may pass as discussed above. Positioning ring 122, which is preferably fastened to support bars 192, preferably has a plurality of circumferential holes 124 for cooperation with a longitudinal lock pin 120 to lock patient support platform 20 in one of several predetermined rotational positions. Lock pin 120, which is mounted in upright frame 144, is capable of limited longitudinal movement along its central axis to engage or disengage a hole 124 of positioning ring 122, as desired. Preferably, lock pin 120 and positioning ring 122 include a twistable locking mechanism for preventing accidental disengagement of lock pin 120 from positioning ring 122. For example, lock pin 120 may be provided with a protrusion such as nub 120*a* that fits through slot 124*a* of hole 124. After pin 120 is pushed through hole 124 sufficiently for nub 120*a* to clear positioning ring 122, handle 120*b* may be used to twist lock pin 120 such that nub 120*a* prevents retraction of pin 120. Alternatively, lock pin 120 and positioning ring 122 may be respectively provided with cooperating parts of a conventional quarter-turn fastener or the like. Any such suitable device for preventing disengagement of lock pin 120 from positioning ring 122 by twisting lock pin 120 about its central axis is referred to herein as a twist lock.

Figure 21:
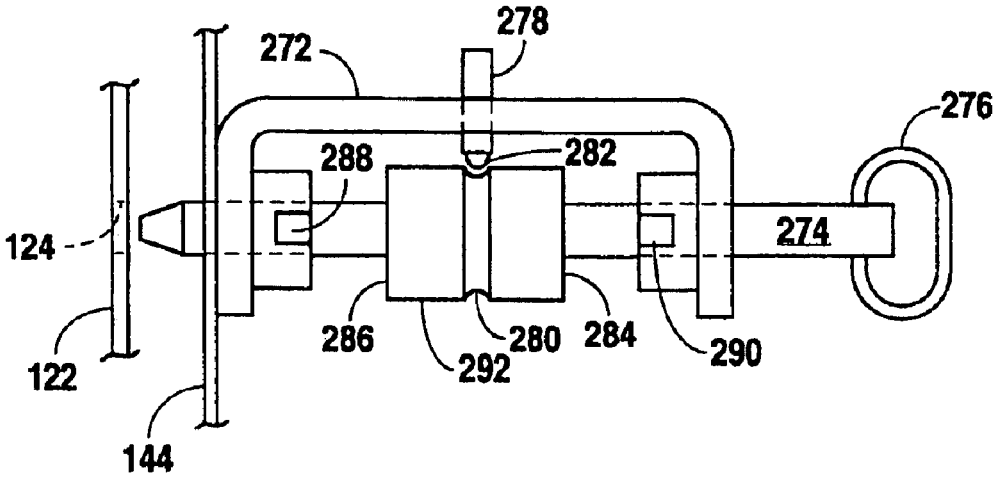
FIG. 21 is a top view of a locking pin assembly for a therapeutic bed in accordance with the present invention.
Figure 22:
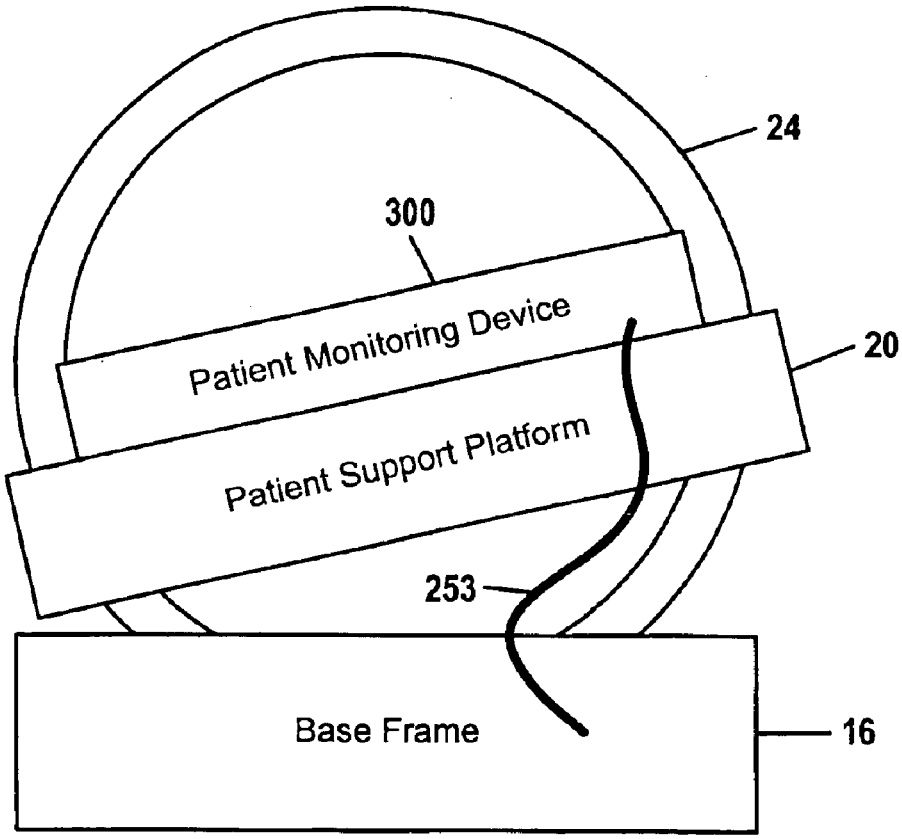
FIG. 22 is a block diagram illustrating a direct electrical connection between a base frame and a patient monitoring device connected to a patient support platform.

More preferably, as illustrated in FIG. 21, a lock pin 274 with a spring-loaded detent 278 and proximity switches 288, 290 may be mounted to frame 144 with a bracket 272. Lock pin 274 has a central boss 292 with a peripheral groove 280 for cooperation with ball 282 of detent 278 in the neutral position shown in FIG. 21. In the neutral position, pin 274 is disengaged from hole 124 of locking ring 122, and proximity switches 288, 290 preferably send "neutral" signals to the control system to electrically prevent rotation of patient support platform 20. If handle 276 is used to push pin 274 into engagement with a hole 124 of locking ring 122, ball 282 of detent 278 engages edge 284 of boss 292, and proximity switch 288 senses edge 286 of boss 292 and sends a "locked" signal to the control system to electrically prevent rotation of patient support platform 20 in addition to the mechanical locking of pin 274 in locking ring 122. If manual rotation of patient support platform 20 is desired, handle 276 may be used to pull pin 274 to its fully retracted position in which ball 282 of detent 278 engages edge 286 of boss 292, and proximity switch 290 senses edge 284 of boss 292 and sends an "unlocked" signal to the control system to allow rotation of patient support platform 20.

Figure 14:
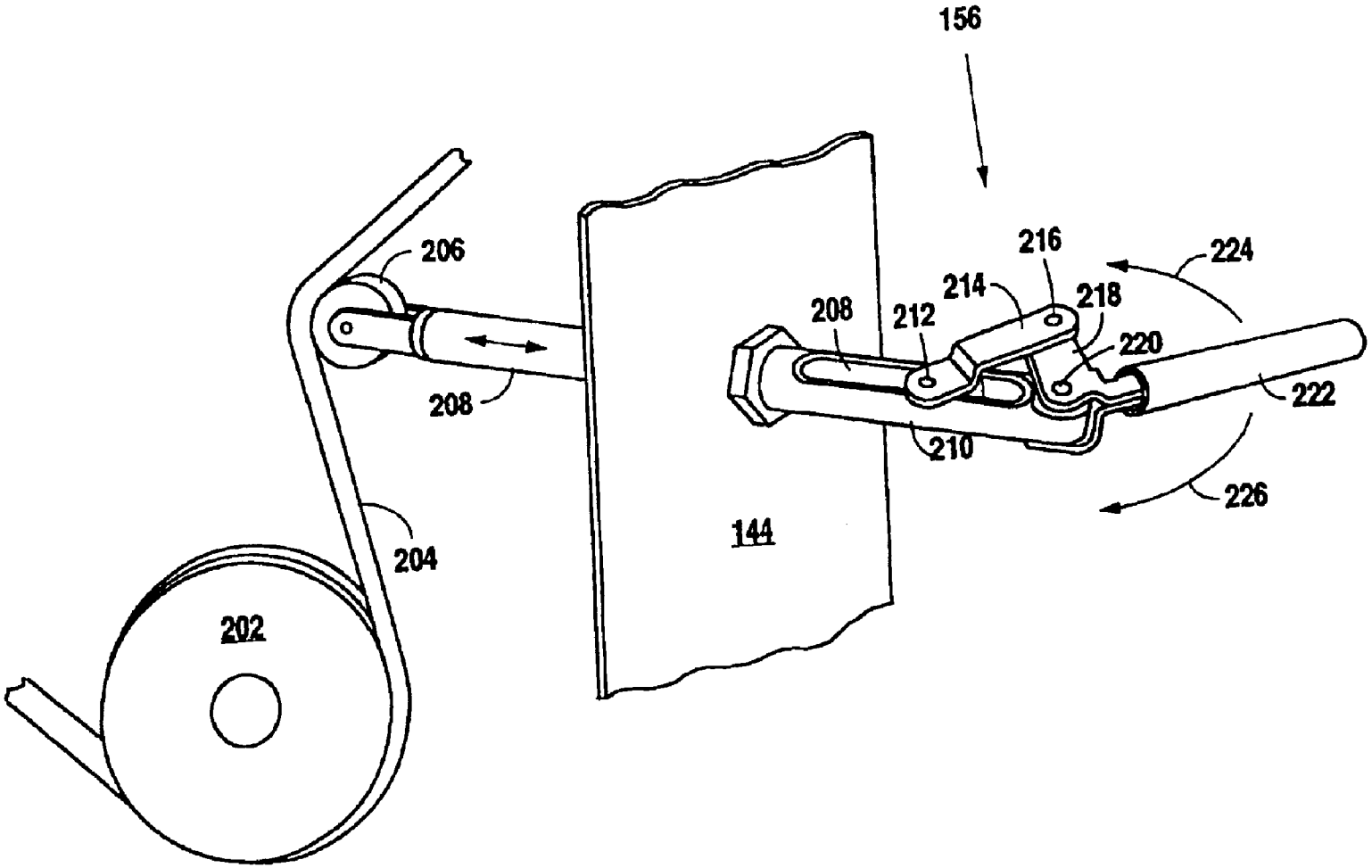
FIG. 14 is a perspective view of the quick release mechanism for the drive system of the therapeutic bed of FIG. 1.

As discussed in international application number PCT/IE99/00049, bed 10 preferably has a drive system essentially comprising a belt drive between patient support platform 20 and an associated electric motor 152 at the foot end of base frame 16. The drive system may be of the type described in Patent Specification No. WO97/22323, which is incorporated herein by reference. As illustrated in FIG. 14, bed 10 preferably includes a quick release mechanism 156 installed on foot frame 144 to provide a means to quickly disengage patient support platform 20 from the belt drive system. Quick release 156 may be conveniently made from a tool and jig lever available from WDS Standard Parts, Richardshaw Road, Grangefield Industry Estate, Pudsey, Leeds, England LS286LE. Quick release 156 comprises a mounting tube 210 secured to foot frame 144. A lever 222 is pinned to tube 210 at point 220. A tab 218 extends from lever 222, and a linkage 214 is pinned to tab 218 at point 216. Linkage 214 is also pinned at point 212 to a shaft 208 that is slidably disposed within tube 210. Shaft 208 extends through foot frame 144 toward belt 204 which is engaged with pulley 202 of the drive system. A roller 206 is attached to shaft 208 for engaging belt 204. By rotating lever 222 in the direction of arrow 224, roller 206 is forced into engagement with belt 204, which provides sufficient tension in belt 204 to engage patient support platform 20 with the drive system. By rotating lever 222 in the direction of arrow 226, roller 206 is retracted from belt 204, which disengages patient support platform 20 from the drive system thereby allowing manual rotation of patient support platform 20. This capability of quick disengagement of the drive system to allow manual rotation of patient support platform 20 is very useful in emergency situations, such as when a patient occupying bed 10 suddenly needs CPR. In such a circumstance, if patient support platform 20 is not in a supine position, a caregiver may quickly and easily disengage the drive system using quick release 156, manually rotate patient support platform 20 to a supine position, and begin administering CPR or other emergency medical care.

As disclosed in international application number PCT/IE99/00049, the rotational position of patient support platform 20, which is governed by motor 152 of the aforementioned drive system, may be controlled through the use of a rotary opto encoder. Alternatively, the rotational position of patient support platform 20 may be controlled through the use of an angle sensor 232 (shown schematically in FIG. 13) of the type disclosed in U.S. Pat. No. 5,611,096, which is incorporated herein by reference. As disclosed in the '096 patent, angle sensor 232 comprises a first inclinometer (not shown) that is sensitive to its position with respect to the direction of gravity. By mounting angle sensor 232 to patient support platform 20 in the proper orientation, the output signal from angle sensor 232 may be calibrated to control the rotational position of patient support platform 20 in cooperation with motor 152. Likewise, angle sensor 232 may include another properly oriented inclinometer (not shown) that may be used in association with rams 15 and 17 (see FIG. 1) to control the Trendelenburg position of patient support platform 20.

Although the foregoing specific details describe a preferred embodiment of this invention, persons reasonably skilled in the art will recognize that various changes may be made in the details of the method and apparatus of this invention without departing from the spirit and scope of the invention as defined in the appended claims. Therefore, it should be understood that this invention is not to be limited to the specific details shown and described herein.

What is claimed is:

1. A therapeutic bed comprising:

a base frame;

a patient support platform rotationally mounted on the base frame and operable to be rotated from a supine position to a prone position;

an electrically powered patient monitoring system connected to the patient support platform; and a direct wired electrical connection between the base frame and the patient monitoring system, a first portion of the wired electrical connection being mounted in fixed relation to the base frame, and a second portion of the wired electrical connection spaced apart from the first portion being mounted in fixed relation to the patient support platform, the direct electrical connection being adapted to flex during rotation of the patient support platform between the supine and prone position, wherein the direct wired electrical connection does not include a wire-brush electrical interface between the base frame and the patient support platform:

the direct wired electrical connection thereby reducing the ask of electrical intermittence caused by vibrations and abrupt movements of the therapeutic bed.

2. The therapeutic bed of claim 1 wherein the patient support platform has a neutral supine position, and wherein the direct electrical connection allows about 360 degrees of rotation of the patient support platform in either direction from the neutral supine position.

3. The therapeutic bed of claim 1 wherein the direct electrical connection comprises a cable carrier having electrical cables disposed therein, the cable carrier having a first portion affixed to the base frame and a second portion affixed to the patient support platform.

4. The therapeutic bed of claim 1 wherein the direct electrical connection comprises a flexible cable having a first portion affixed to the base frame and a second portion affixed to the patient support platform.

5. The therapeutic bed of claim 1 further comprising a rotation limiter that limits the rotation of the patient support platform to that which will preserve the direct electrical connection.

6. The therapeutic bed of claim 5 further comprising a pair of sensors mounted to the base frame, wherein the rotation limiter respectively activates one of the pair of sensors depending on the direction of rotation of the patient support platform, and wherein each one of the pair of sensors produces a signal representative of the direction of rotation of the patient support platform when respectively activated by the rotation limiter.

7. A therapeutic bed comprising:

a base frame;

a patient support platform rotationally mounted on the base frame;

a cable not physically connected to any wire-brush electrical interface, for conveying power or electrical signals to the patient support platform; and a cable housing mounted to the patient support platform, the cable housing defining a channel to shield and prevent entanglement of the cable during rotation of the patient support platform.

8. The therapeutic bed of claim 7, wherein the cable housing defines an annular channel.

9. The therapeutic bed of claim 8, wherein the cable housing has a C-shaped cross section.

10. The therapeutic bed of claim 7, wherein a first portion of the cable is fixedly attached to the cable housing.

11. The therapeutic bed of claim 7, wherein the cable comprises a direct electrical connection.

12. The therapeutic bed of claim 7, wherein the cable comprises a plurality of flexible conductive strips surrounding by flexible insulator.

13. The therapeutic bed of claim 7, wherein the cable is a flat ribbon cable.

14. The therapeutic bed of claim 7, further comprising a stationary cover for the cable housing, the cover being affixed to the base frame, wherein the cover, unlike the cable housing, remains stationary during rotation of the patient support platform.

15. The therapeutic bed of claim 14, wherein a first portion of the cable is fixedly attached to the cable housing and a second portion of the cable is fixedly attached to the cover.

16. The therapeutic bed of claim 14, wherein the cover comprises metal to shield the cable from electromagnetic interference.

17. A therapeutic bed comprising:

a base frame;

a patient support platform rotationally mounted on the base frame;

a cable not physically connected to any wire-brush electrical interface, for conveying power or electrical signals to the patient support platform;

a cable housing mounted the patient support platform so that it rotates with the patient support platform, the cable housing defining a channel to shield and prevent entanglement of the cable during rotation of the patient support platform; and a stationary cover for the cable housing, the cover being affixed to the base frame, wherein the cover remains stationary during rotation of the patient support platform;

wherein a first portion of the cable is fixedly attached to the cable housing and a second portion of the cable is fixedly attached to the cover.

18. The therapeutic bed of claim 17 wherein the patient support platform has a neutral supine position, and wherein the distance between the first and second portions of the cable is sufficiently long to allow about 360 degrees of rotation of the patient support platform in either direction from the neutral supine position.

19. The therapeutic bed of claim 18, wherein the cable comprises a plurality of flexible conductive strips surrounding by flexible insulator.

20. The therapeutic bed of claim 19, wherein the cover comprises metal to shield the cable from electromagnetic interference.

* * * * *

UNITED STATES PATENT AND TRADEMARK OFFICE

CERTIFICATE OF CORRECTION

PATENT NO. : 6,934,986 B2
DATED : August 30, 2005
INVENTOR(S) : Krywiczanin et al.

It is certified that error appears in the above-identified patent and that said Letters Patent is hereby corrected as shown below:

Column 10,
Line 61, replace the word “position” with -- positions --.
Line 66, replace the word “ask” with -- risk --.

Signed and Sealed this

Sixth Day of December, 2005

JON W. DUDAS
*Director of the United States Patent and Trademark Office*